US009226555B1

(12) United States Patent
Shyu

(10) Patent No.: US 9,226,555 B1
(45) Date of Patent: Jan. 5, 2016

(54) CANE STRUCTURE

(71) Applicant: Shing Hae Shyu, Miaoli County (TW)

(72) Inventor: Shing Hae Shyu, Miaoli County (TW)

( * ) Notice: Subject to any disclaimer, the term of this patent is extended or adjusted under 35 U.S.C. 154(b) by 0 days.

(21) Appl. No.: 14/479,137

(22) Filed: Sep. 5, 2014

(51) Int. Cl.
*A45B 9/02* (2006.01)
*A45B 3/04* (2006.01)

(52) U.S. Cl.
CPC .... *A45B 9/02* (2013.01); *A45B 3/04* (2013.01)

(58) Field of Classification Search
USPC ..... 135/114, 72, 65, 66; 138/140, 141, 145, 138/147; 264/279.1
See application file for complete search history.

(56) References Cited

U.S. PATENT DOCUMENTS 1,427,138 A * 8/1922 Walicki et al. ..... 362/157
2,478,325 A * 8/1949 Russell ..... 362/102
4,625,742 A * 12/1986 Phillips ..... 135/66
5,582,196 A * 12/1996 Hae et al. ..... 135/65
5,722,445 A 3/1998 Hae et al.
6,079,894 A * 6/2000 Obitts ..... 403/109.3
8,439,056 B2 5/2013 Shyu
2005/0005961 A1* 1/2005 Chang ..... 135/159
2007/0251559 A1* 11/2007 Yu ..... 135/66
2008/0251109 A1* 10/2008 Lee ..... 135/66
2009/0199884 A1* 8/2009 Lessing ..... 135/66
2011/0271990 A1* 11/2011 Diamond ..... 135/65
2012/0140450 A1* 6/2012 Motyka et al. ..... 362/102

* cited by examiner

*Primary Examiner* — Noah Chandler Hawk
(74) *Attorney, Agent, or Firm* — Ming Chow; Sinorica, LLC

(57) ABSTRACT

A cane structure includes a handle, an electrical components set, a stick, a sleeve, a cap button, a compression spring, and a biasing post. The handle defines a receiving chamber and an inner chamber. Multiple protrusions are formed on the surrounding wall of the inner chamber. The electrical components set is removably mounted in the receiving chamber. The stick is attached to the bottom portion of the handle and conceals the inner chamber. The sleeve is fixedly disposed in the inner chamber of the handle, wherein the sleeve defines multiple through holes for being inserted with the protrusions. Also, the sleeve abuts a step in the inner chamber. The cap button and the compression spring are fitted in the sleeve. The biasing post is fitted into the sleeve and urged against the compression spring, so that the cap button can enter the receiving chamber to engage the electrical components set.

8 Claims, 3 Drawing Sheets

CANE STRUCTURE

(a) TECHNICAL FIELD OF THE INVENTION

The present invention relates to a cane structure and, more particularly, to a cane structure including a sleeve that can be firmly fixed to a handle to facilitate assembling the clipping mechanism.

(b) DESCRIPTION OF THE PRIOR ART

U.S. Pat. No. 5,722,445 is an invention, concerning a multipurpose cane, disclosed by the applicant. The multipurpose cane generally comprises a handle, an electrical components set, a stick, and a clipping element. The handle defines a horizontal receiving chamber at the top portion of the handle and a vertical inner chamber at the root portion of the handle, wherein the inner chamber communicates with the receiving chamber. The electrical components set, including a battery cell, a printed circuit board, a lamp, a push button switch and a warning light, is provided in the receiving chamber of the handle, wherein the warning light is located at the rear of the electrical components set. The bottom of the electrical components set defines a recess. The stick is attached to the root portion of the handle. The clipping element, including a biasing post, a compression spring and a cap button, is received in the inner chamber of the root portion of the handle. The compression spring urges against the cap button, so that the top of the cap button projects into the receiving chamber and inserted into the recess of the electrical components set, so that the electrical components set can be removably snapped into the handle.

As to other existing canes, the inner chamber of the root portion of the handle is attached with a sleeve to receive the cap button, the compression spring, and the biasing post.

In view of the disclosed patent and other existing canes, the applicant thinks they contain the following disadvantages:

1. The sleeve is attached with the surrounding wall of the inner chamber of the handle via adhesive. Consequently, after a period of use the sleeve may detach from the surrounding wall of the inner chamber due to the aging of the adhesive, and thus the arrangement of the compression spring and the cap button will become loose, so that the engagement between the electrical components set and the cap button will be reduced, causing an improper mounting of the electrical components set.

2. In the battery cell, there is no foolproof structure for preventing an incorrect installation of batteries (the elderly is easy to take the mistake), which may cause a damage or failure of the printed circuit board of the electrical components set.

3. The top of the cap button is projected into the receiving chamber of the handle and inserted into the recess of the electrical components set. Consequently, after multiple operations of mounting or dismounting the electrical components set, the wear of the cap button will become significant, and thus the engagement between the electrical components set and the cap button will be reduced, causing an improper mounting of the electrical components set.

For improving the disclosed patent and other existing canes, based on long-term experiences of developing related products and numerous tests, the applicant has contrived an improved cane structure, which enables the sleeve to be firmly disposed in the inner chamber of the handle without using adhesive.

SUMMARY OF THE INVENTION

One object of the present invention is to provide a cane structure, wherein the handle is provided with a plurality of protrusions and a step, in the inner chamber thereof, which can be fitted into the through holes of a sleeve, whereby the sleeve can be disposed in the inner chamber more firmly, thereby facilitating in assembling the clipping mechanism to the handle.

To achieve the above object, the cane structure may comprise a handle, an electrical components set, a stick, a sleeve, a cap button, a compression spring, and a biasing post. The handle has a top portion and a bottom portion, wherein the top portion defines a receiving chamber extending horizontally, and the bottom portion defines an inner chamber extending vertically. A plurality of protrusions are formed on the surrounding wall of the inner chamber. The top of the inner chamber defines a central hole communicating with both the receiving chamber and the inner chamber, and is formed with one or more steps around the central hole. The electrical components set is removably mounted in the receiving chamber of the handle. The stick is attached to the bottom portion of the handle and conceals the inner chamber of the bottom portion of the handle. The sleeve is fixedly disposed in the inner chamber of the bottom portion of the handle, wherein the sleeve defines a plurality of through holes, corresponding to the protrusions formed on the surrounding wall of the inner chamber, for being inserted with the protrusions, and the top of the sleeve abuts the step formed at the top of the inner chamber. The cap button and the compression spring are fitted in the sleeve disposed in the inner chamber of the bottom portion of the handle. The biasing post is fitted into the sleeve disposed in the inner chamber and urged against the compression spring, wherein the compression spring is located between the cap button and the biasing post, so that the cap button is capable of projecting out of the central hole defined at the top of the inner chamber to enter the receiving chamber, thereby engaging the electrical components set.

In manufacturing, the sleeve can be placed in a mold cavity for the handle and then molten thermoplastic material can be introduced to the cavity to have the sleeve formed together with the handle. Due to the inherent pressure of the molten thermoplastic material, a plurality of protrusions can be formed in the through holes of the sleeve. After the temperature drops, the hardened protrusions can block the sleeve from movement. The way of manufacturing the handle can enhance the combination of the handle and the sleeve without using adhesive.

With the integral manufacturing of the handle and the sleeve, the molten thermoplastic material filling in the through holes of the sleeve can form the protrusions required for blocking the movement of the sleeve. In addition, the steps, which are formed in the integral manufacturing to abut the two ends of the sleeve, can increase the combination effect of the handle and the sleeve to prevent the sleeve from being loosened and facilitate the clipping mechanism, including the cap button, the compression spring and the biasing post, being assembled to the handle.

Other objects, advantages, and novel features of the present invention will become more apparent from the following detailed description when taken in conjunction with the accompanying drawings.

DETAILED DESCRIPTION OF THE PREFERRED EMBODIMENTS

Figure 1:
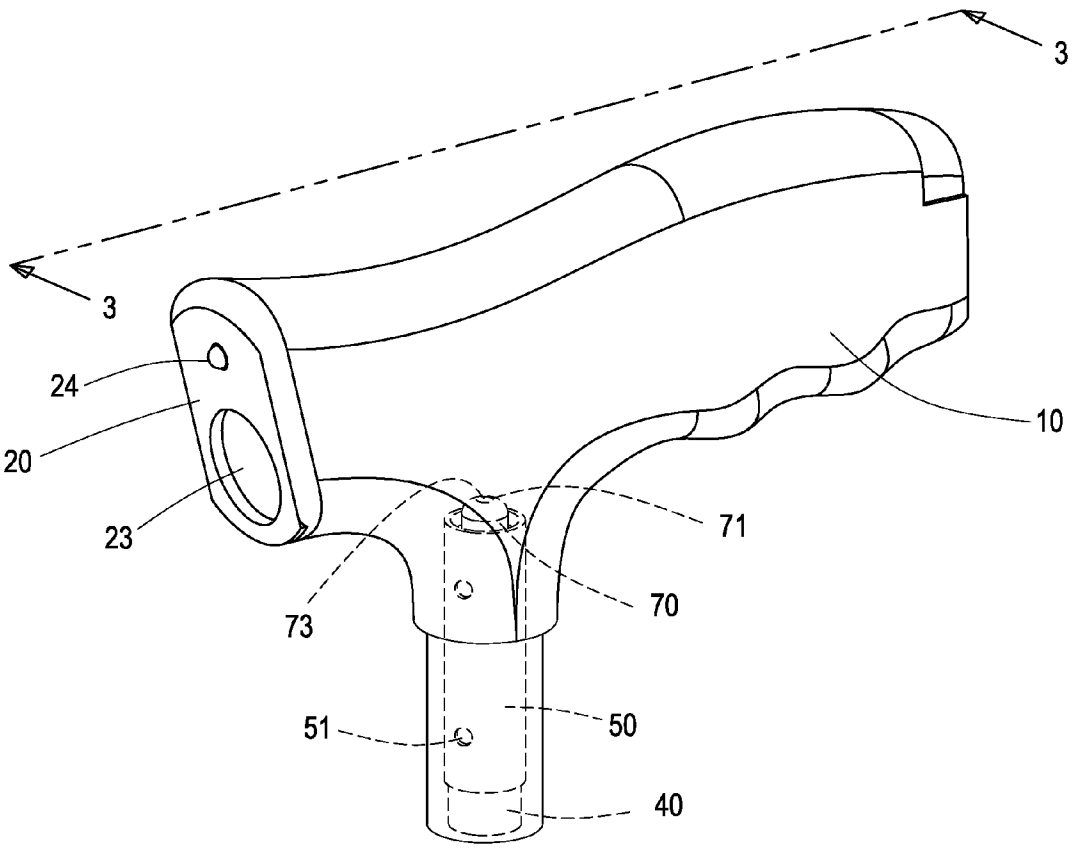
FIG. 1 shows a 3-dimensional view of a cane structure according one embodiment of the present invention.
Figure 2:
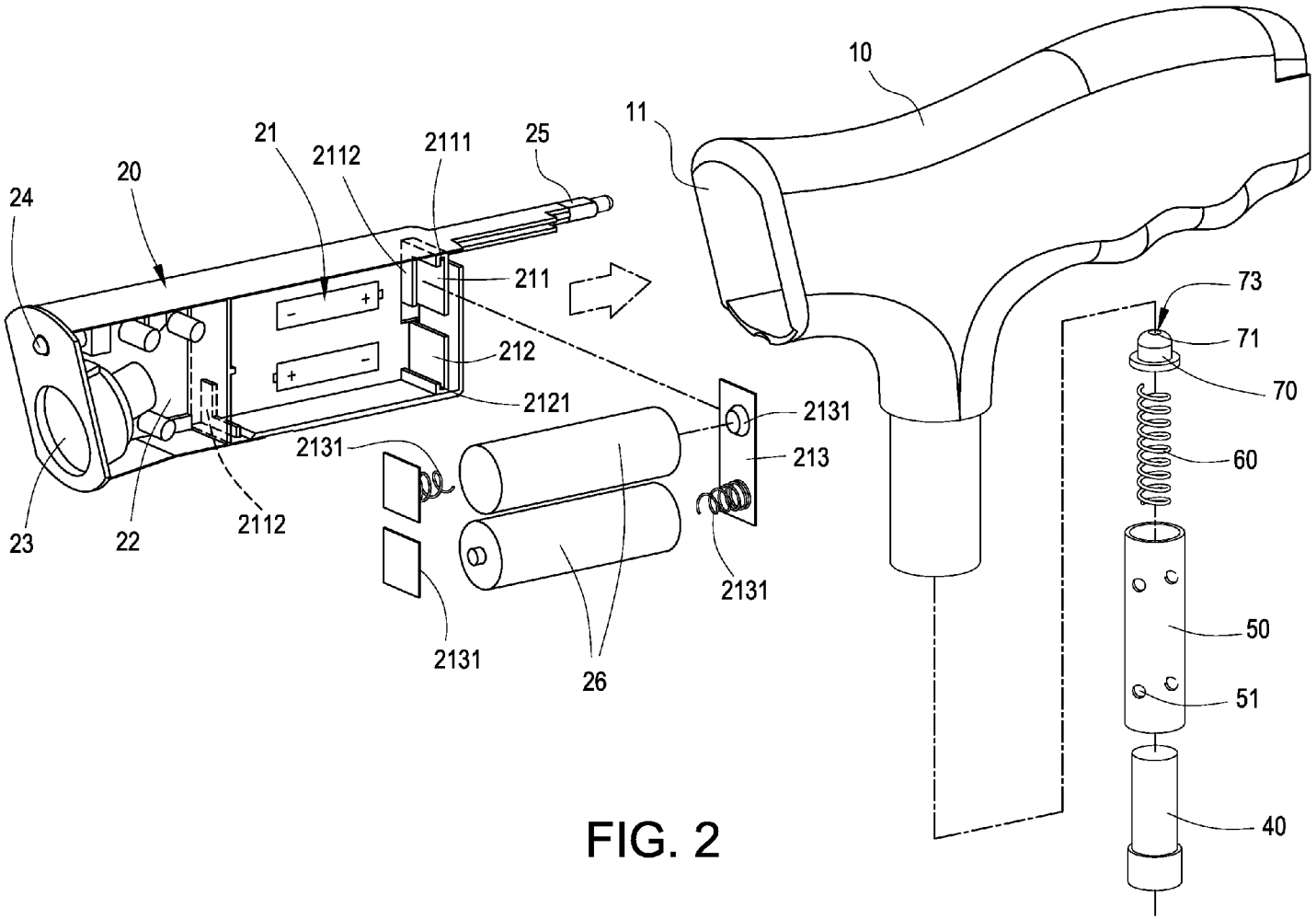
FIG. 2 shows an exploded view of the can structure of the embodiment of the present invention.
Figure 3:
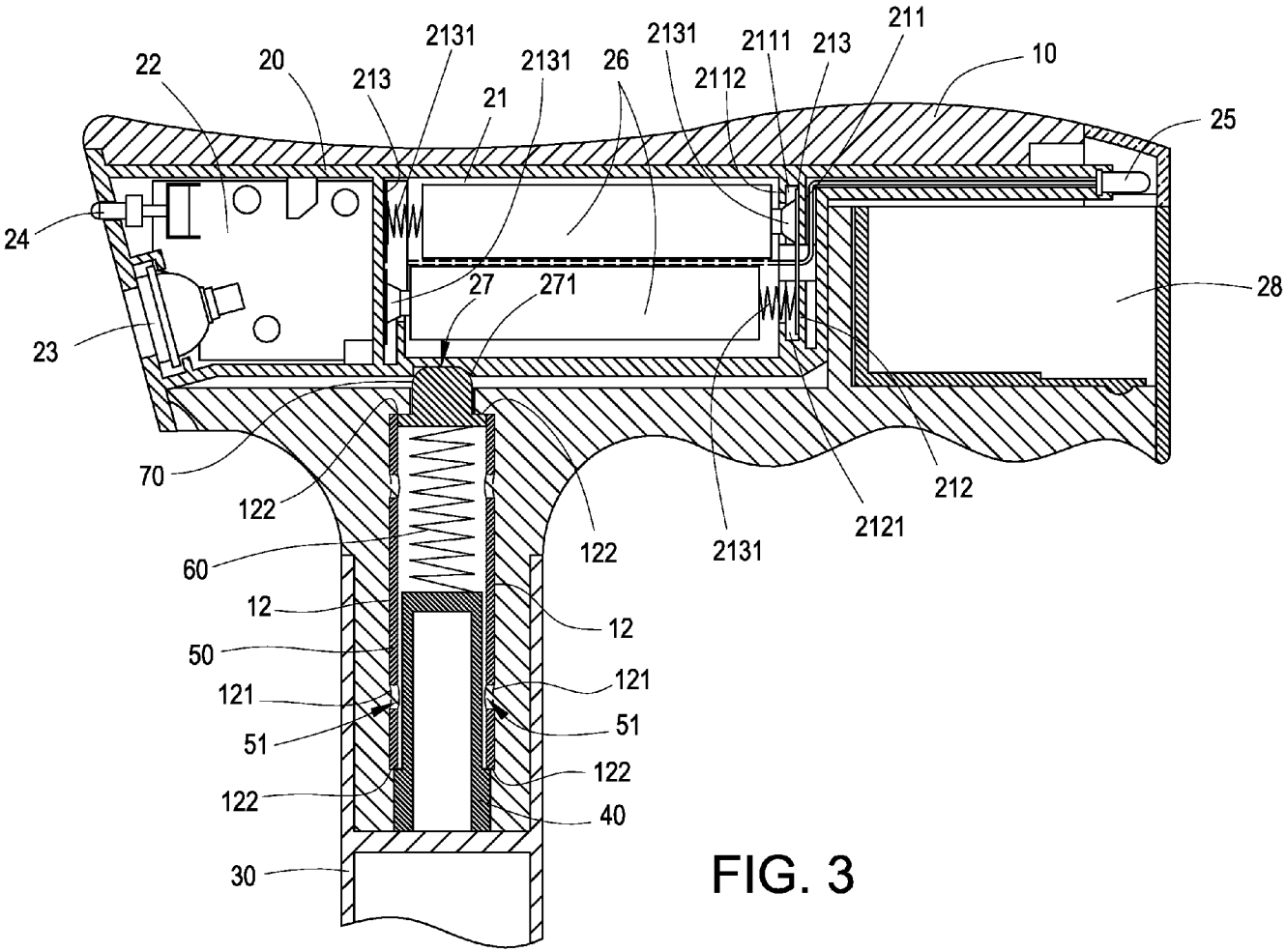
FIG. 3 shows a sectional view of the cane structure of the embodiment of the present invention.

Referring to FIGS. 1 through 3, a cane structure according to one embodiment of the present invention is shown, which generally comprises a handle 10, an electrical components set 20, a stick 30, a sleeve 50, a cap button 70, a compression spring 60, and a biasing post 40.

The handle 10 has a top portion and a bottom portion, wherein the top portion defines a receiving chamber 11 extending horizontally, and the bottom portion defines an inner chamber 12 extending vertically. Furthermore, a plurality of protrusions 121 are formed on the surrounding wall of the inner chamber 12; the top of the inner chamber 12 defines a central hole communicating with both the receiving chamber 11 and the inner chamber 12 and is formed with a step 122 around the central hole. Furthermore, another step 122 is formed on the surrounding wall of the inner chamber 12 opposite to the aforementioned step 122 formed at the top of the inner chamber 12.

The electrical components set 20 is removably mounted in the left half of the receiving chamber 12 of the top portion of the handle 10. The stick 30 is attached to the bottom portion of the handle 10 and conceals the inner chamber 12.

The sleeve 50, which can be a metal element, is fixedly disposed in the inner chamber 12 of the handle 10, wherein the top of the sleeve 50 abuts the top step 122 whereas the bottom of the sleeve 50 abuts the bottom step 122; the sleeve 50 defines a plurality of through holes 51, corresponding to the protrusions 121 formed on the surrounding wall of the inner chamber 12, for being inserted with the protrusions 121. As such, the sleeve 50 can be fixed to the handle 10 more firmly. It is noted that the bottom step 122 can be omitted to enable the sleeve 50 to be firmly fixed to the handle 10 as well.

The cap button 70 and the compression spring 60 are fitted in the sleeve 50 fixedly disposed in the inner chamber 12 of the handle 10. The upper section of the biasing post 40 is fitted into the sleeve 50 fixedly disposed in the inner chamber 12 of the handle 10 and urged against the compression spring 60, wherein the compression spring 60 is located between the cap button 70 and the biasing post 40, so that the cap button 70 is capable of projecting out of the central hole defined at the top of the inner chamber 12 to enter the receiving chamber 11, thereby engaging the electrical components set 20.

The bottom of the electrical components set 20 defines a recess 27. Thus, when the electrical components set 20 is mounted in the receiving chamber 11 of the handle 10, the cap button 70 can be inserted into the recess 27, so that the electrical components set 20 can be snapped into the handle 10; when the electrical components set 20 requires to be taken out of the receiving chamber 11 of the handle 10, for example, for replacing batteries, the electrical components set 20 can be pulled out of the receiving chamber 11. Preferably, the rear side of the recess 27 is formed as a slant surface 271 to facilitate the recess 27 to engage with or disengage from the cap button 70.

With the clipping mechanism, including the cap button 70, the compression spring 60 and the biasing post 40, being worked with the sleeve 50 fixedly disposed in the inner chamber 12 of the handle 10, the electrical components set 20 can be removably snapped into the handle 10.

In manufacturing, the sleeve 50 can be placed in a mold cavity for the handle 10 and then molten thermoplastic material can be introduced to the cavity to have the sleeve 50 formed together with the handle 10. Due to the inherent pressure of the molten thermoplastic material, a plurality of protrusions can be formed in the through holes 51 of the sleeve 50. After the temperature drops, the hardened protrusions can block the sleeve 50 from movement. The way of manufacturing the handle 10 can enhance the combination of the handle 10 and the sleeve 50. In addition, the steps 12, which abut the two ends of the sleeve 50, can increase the combination effect of the handle 10 and the sleeve 50 to facilitate the cap button 70, the compression spring 60, and the biasing post 40 being assembled to the handle 10.

In the embodiment, the electrical components set 20 includes a battery enclosure 21, a circuit board 22, a lamp 23, a switch 24, and a warning light 25. As shown, the battery enclosure 21 accommodates two D-type batteries. The battery enclosure 21 is provided with a plurality of holders 211, 212 and a plurality of conductive sheets 213. The holders 211, 212 respectively define slots 2111, 2121 for holding conductive sheets 213. In the embodiment, two front conductive sheets 213 and one rear conductive sheet 213 are employed, wherein the front conductive sheets 213 are each provided with a contact 2131, whereas the rear conductive sheet 213 is provided with two contacts 2131.

In the embodiment, for ensuring a correct installation of the batteries, the holders 211, which are intended for holding the electrical sheets for the positive terminals of the batteries 26, are each provided with an L-shaped blocking wall 2112, which serves as a foolproof structure. As such, when the negative terminal of a battery is located at the holder with the L-shaped blocking wall 2112, the battery will be blocked from being electrically connected with the associated conductive sheet 213 therein to prevent an incorrect electrical connection that may cause a damage or failure to the circuit board 22.

In the embodiment, the cap button 70 defines an aperture 73 at its top to be inserted with an anti-wear element 71. Alternatively, the top of the cap button 70 can be directly provided with an anti-wear element 71. The anti-wear element 71 can be made of metals, ceramics, or stones, to alleviate the abrasion of the cap button that engages the electrical components set 20.

Furthermore, in the embodiment, a storage box 28 is removably mounted in the right half of the receiving chamber 11, opposite to the electrical components set 20 mounted in the left half of the receiving chamber 11. The storage box 28 can be taken out of the receiving chamber 11 to receive various objects, such as emergency medicines, batteries, coins, and so on. With the storage box 28, a user can carry necessary medicines or objects, along with the cane, conveniently.

As a summary, the present invention provides a plurality of protrusions on the surrounding walls of the inner chamber of the handle, wherein the protrusions are fitted into the through holes of the sleeve. Furthermore, at least one step is formed in the inner chamber of the handle to increase the combination effect of the handle and the sleeve, so that the sleeve can be disposed in the inner chamber of the handle more firmly, thereby facilitating the clipping mechanism being assembled to the handle. This feature has not yet disclosed in the prior art.

Although the present invention has been described with a certain degree of particularity, it is understood that the present disclosure is made by way of example only and the combination and arrangement of parts may be resorted to without departing from the spirit and scope of the invention hereinafter claimed.

I claim:

1. A cane structure, comprising:

a handle having a top portion and a bottom portion, wherein the top portion defines a receiving chamber extending horizontally, and the bottom portion defines an inner chamber extending vertically, wherein a plurality of protrusions are formed on the surrounding wall of the inner chamber, and the top of the inner chamber defines a central hole communicating with both the receiving chamber and the inner chamber and is formed with a step around the central hole;

an electrical components set removably mounted in the receiving chamber of the handle;

a stick attached to the bottom portion of the handle and concealing the inner chamber of the bottom portion of the handle;

a sleeve fixedly disposed in the inner chamber of the bottom portion of the handle, wherein the sleeve defines a plurality of through holes, corresponding to the protrusions formed on the surrounding wall of the inner chamber, for being inserted with the protrusions, a top of the sleeve abuts the step formed at the top of the inner chamber, a bottom of the sleeve abuts a bottom step;

a cap button fitted in the sleeve fixedly disposed in the inner chamber of the bottom portion of the handle;

a compression spring fitted in the sleeve fixedly disposed in the inner chamber of the bottom portion of the handle;

an upper section of a biasing post fitted into the sleeve fixedly disposed in the inner chamber and urged against the compression spring, wherein the compression spring is located between the cap button and the biasing post, so that the cap button is capable of projecting out of the central hole defined at the top of the inner chamber to enter the receiving chamber, thereby engaging the electrical components set;

a clipping mechanism comprising the cap button, the compression spring, and the biasing post fixedly disposed in the inner chamber, the electrical components set removably snapped into the handle;

the electrical components set comprising a circuit board, a lamp, a switch, and a warning light;

the electrical components set containing a battery enclosure for accommodating at least one battery therein, the battery enclosure being provided with a plurality of holders and a plurality of conductive sheets being held in the holders, the plurality of conductive sheets comprising two front conductive sheets and one rear conductive sheets, the front conductive sheets provided with a contact and the rear conductive sheet provided with two contacts;

the bottom of the electrical components set defining a recess for being engaged with the cap button, whereby the electrical components set is removably mounted in the receiving chamber of the handle, the cap button being capable of insertion into the recess, whereby the electrical components are snapped into the handle; and the sleeve integrally formed with the handle by placing the sleeve in a mold cavity for the handle, which is then introduced with molten thermoplastic material, pressure of the molten thermoplastic material forming the protrusions through the holes, and after a temperature drop the protrusions block the sleeve from moving.

2. The cane structure of claim 1, wherein each of the holders defines a slot to hold one of the conductive sheets.

3. The cane structure of claim 1, wherein at least one holder is provided with an L-shaped blocking wall to prevent the negative terminal of a battery from being in contact with the associated conductive sheet therein.

4. The cane structure of claim 1, wherein the cap button is provided with an anti-wear element at its top.

5. The cane structure of claim 4, wherein the anti-wear element is made of metal.

6. The cane structure of claim 1, wherein the rear side of the recess is formed as a slant surface to facilitate the recess to engage with or disengage from the cap button.

7. The cane structure of claim 1, further comprising a storage box that is removably mounted in the receiving chamber opposite to the electrical components set.

8. The cane structure of claim 1, wherein the bottom step is formed on the surrounding wall of the inner chamber of the handle such that the bottom of the sleeve abuts the bottom step.

* * * * *